United States Patent [19]

Bauer et al.

[11] 4,302,929

[45] Dec. 1, 1981

[54] HAIRY MONOCOMPONENT YARN

[75] Inventors: Günther Bauer, Königsbrunn; Wolfgang Burghardt, Bobingen; Hilmar Möller, Neusäss-Westheim, all of Fed. Rep. of Germany

[73] Assignee: Hoechst Aktiengesellschaft, Fed. Rep. of Germany

[21] Appl. No.: 95,977

[22] Filed: Nov. 20, 1979

[30] Foreign Application Priority Data

Nov. 24, 1978 [DE] Fed. Rep. of Germany ..... 2850853

[51] Int. Cl.[3] ..... D02G 1/02; D02G 3/24

[52] U.S. Cl. ..... 57/247; 57/288

[58] Field of Search ..... 57/2, 245, 246, 247, 57/284, 286, 287, 288

[56] References Cited

U.S. PATENT DOCUMENTS

| | | | |
|---|---|---|---|
| 3,857,232 | 12/1974 | Heinrich et al. | 57/2 |
| 3,857,233 | 12/1974 | Cardinal et al. | 57/287 X |
| 3,946,548 | 3/1976 | Hino et al. | 57/2 X |
| 3,987,614 | 10/1976 | Cardinal et al. | 57/287 X |
| 4,044,541 | 8/1977 | Ikeda | 57/247 X |
| 4,054,025 | 10/1977 | Kubitzek et al. | 57/247 X |
| 4,059,950 | 11/1977 | Negishi et al. | 57/288 X |
| 4,110,965 | 9/1978 | Bradley et al. | 57/288 |
| 4,115,990 | 9/1978 | Dudzik | 57/2 X |

FOREIGN PATENT DOCUMENTS 2211843 9/1973 Fed. Rep. of Germany .

*Primary Examiner*—John Petrakes

*Attorney, Agent, or Firm*—Connolly and Hutz

[57] ABSTRACT

The invention provides a voluminous, false twist texturized filament yarn having a great number of individual protruding filament ends; the filaments forming the filament yarn being of the same polyester raw material. The strength of such filament yarns must be of from 1.3 and 1.7 cN/dtex at a clamping length of 5 cm, and at a clamping length of 200 cm of less than 75% of the strength at 5 cm of clamping length, at least however of 0.8 cN/dtex, and the unevenness of the yarn must be less than 3 Uster %.

These filament yarns can be processed to web-like structures which correspond to webs made from staple fiber yarns obtained by secondary spinning with respect to their textile properties, their handle, drape and appearance, and which furthermore are distinguished by their low pilling.

5 Claims, 2 Drawing Figures

HAIRY MONOCOMPONENT YARN

Figure 1:
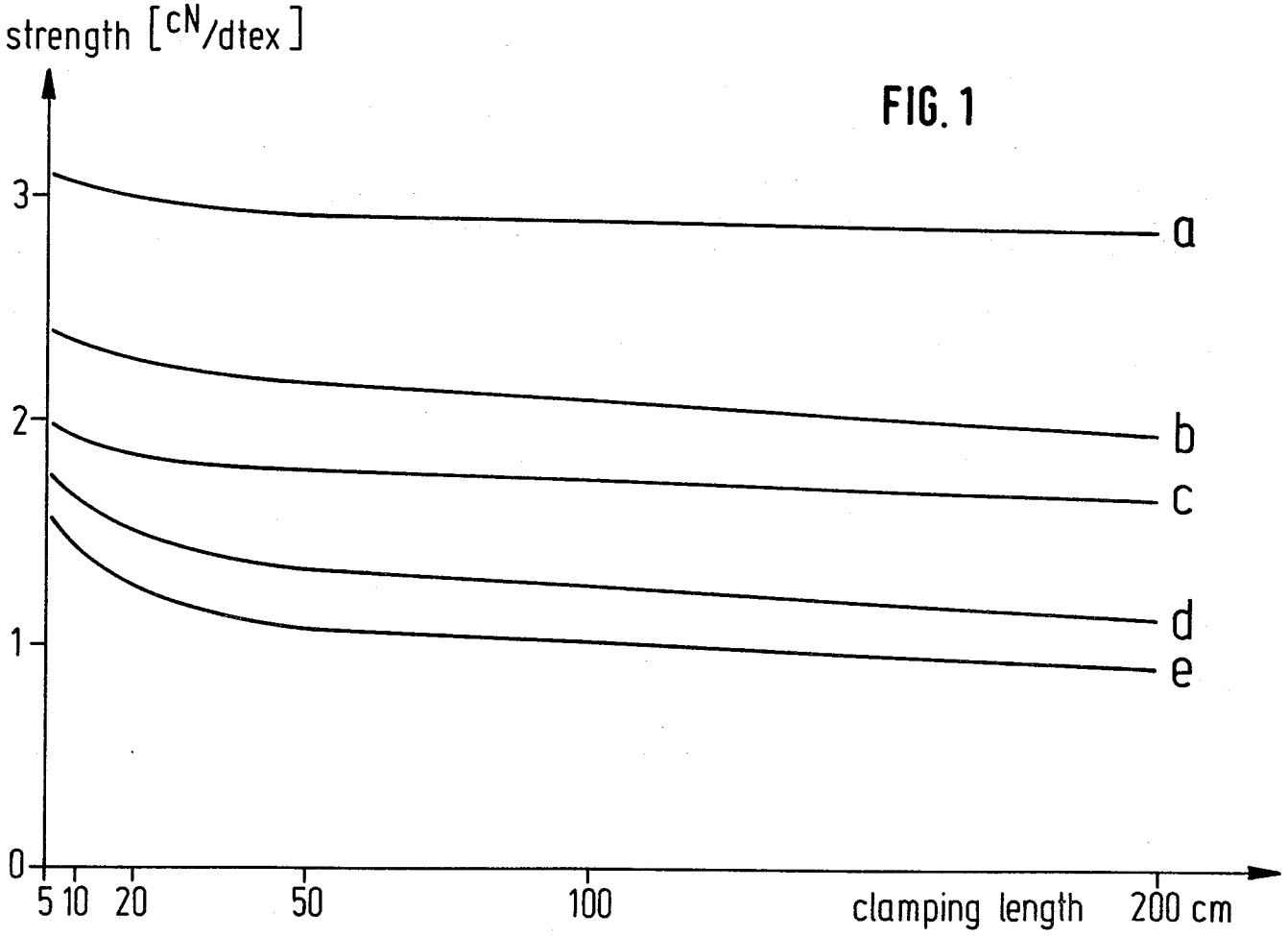

The present invention relates to a voluminous, false twist texturized filament yarn having a great number of individual protruding filament ends which consists of filaments of the same kind.

In German Offenlegungsschrift No. 27 56 641, the manufacture of a filament yarn having protruding filament ends is described, in which all filaments must be of a uniform raw material, but must differ with respect do elongation, profile and titer. In this process, protruding filament ends cannot be produced but by breakage of the component having the lowest elongation to break. The yarns obtained have therefore the known disadvantages stemming from overstretched or torn monofilaments and they do not yield low-pilling textile webs.

These disadvantages could possibly be avoided by the process of German Auslegeschrift No. 23 08 031, according to which the individual filaments break by transversal stress only; however, the teaching of this publication cannot be applied to the manufacture of filament yarns having a large number of protruding filament ends made from a uniform raw material.

Although the specification of German Auslegeschrift No. 23 08 031 mentions yarns made from a uniform raw material, all the Examples, however, demonstrate the use of blended yarns only, in which part of the filaments on texturizing remain continuous and the other part only forms protruding ends by breaking. In several cases moreover, the different properties of these two filament groups in the bicomponent yarns are utilized for producing further effects, for example a bulk effect.

Bicomponent yarns of the cited kind bring about a good yarn strength, because the strength of part of the filaments remains unbroken. However, these yarns cannot be manufactured but in complicated processes. Either a bicomponent spinning equipment such as described in U.S. Pat. No. 2,398,729 must be used, or the filament groups are spun on separate spinning machines and plyed after the separate spinning or before draw texturizing. This plying, moreover, involves the risk of inhomogeneous or incomplete blending and the corresponding negative consequences with respect to the appearance of the structured shaped articles manufactured therefrom.

As already mentioned before, the teaching of German Auslegeschrift No. 23 08 031 cannot be applied to the manufacture of filament yarns having a great number of protruding filament ends from a uniform raw material, since the choice of a defined flex abrasion resistance determines simultaneously and inevitably the number of protruding filament ends, as well as the strength and the pilling behavior. In the case where the manufacture of a yarn having a high degree of hairiness from a uniform filament raw material according to the teaching of the cited German Auslegeschrift was attempted, the flex abrasion resistance of the filaments had to be reduced to such an extent that the voluminous bulked yarns obtained did no longer possess the minimum yarn strength required for further processing. On the other hand, however, a great number of protruding filament ends are required for a false twist texturized filament yarn in order to attain the good performance properties of staple fiber yarns manufactured by secondary spinning.

For this reason, staple fiber yarns obtained by secondary spinning have generally been used hitherto for the manufacture of textile webs containing a great number of protruding filament ends, which yarns consisted substantially of fibers having a reduced flex abrasion resistance of mostly less than 1000 cycles.

It is the object of the invention to provide a voluminous false twist texturized filament yarn having a great number of individual protruding filament ends, which consists of filaments made from the same polymer raw material, and which can be processed to web-like structures, the textile properties, handle, drape, appearance and pilling behavior of which correspond to those manufactured from staple fiber yarns obtained by secondary spinning.

In accordance with the invention, there has been surprisingly found that a yarn according to the preamble of claim 1 has the intended performance properties in the case where its strength at a clamping length of 5 cm is below about 1.7 cN/dtex but above 1.3 cN/dtex, and the strength at a clamping length of 200 cm is less than 75% of the strength at 5 cm, but at least 0.8 cN/dtex, and the unevenness of the yarn is less than 3 Uster %.

The protruding filament ends have preferably a flex abrasion resistance of from 50 to 400 cycles. Especially preferred in accordance with the invention is a yarn formed of identical filaments which do not differ with respect to titer and profile.

Polyethylene terephthalate having a relative viscosity of from 1.5 to 1.65, especially 1.55 to 1.60, modified with 0.3 to 0.8 weight %, especially 0.5 to 0.7 weight %, of trimethylolpropane, has proved to be the preferred raw material for the manufacture of the yarns of the invention. In case of using other branching or cross-linking agents, the amounts of these additives are chosen according to their influence on the flex abrasion resistance.

It has been found in corresponding tenacity tests that the curve of strength of the yarns of the invention in relation to the clamping length corresponds substantially to that of staple fiber yarns obtained by secondary spinning from low-pilling raw materials. This coincidence is probably the main reason for the good textile properties of the filament yarn of the invention containing a great number of individual protruding filament ends. The indicated limits for the yarn strength are critical, since below the minimum value of the yarn cannot be processed perfectly on the usual processing machines. It must for example be assumed that a filament sample having a length of 5 cm is stretched on knitting by about 10%, and that it still must have a strength of 1.30 cN/dtex, while filament strands having a length of up to 2 m which are fed to a knitting machine are subjected to a strain of at least 0.8 cN/dtex due to braking and deflecting operations. Furthermore, the perfect evenness of the filament yarn must be maintained, that is, burls or slubs must not occur or be present in the yarn.

The curve of strength in relation to the clamping length obtained in a tenacity test is used as measure for yarn evenness in the case of yarns manufactured by secondary spinning (Herzog, Melliand Textilberichte 1969, p. 268), and it is furthermore a measure for the staple length of a fiber yarn, or, in the case of filament yarns having protruding filament ends, it is a reliable measure for the number of filament ends (U.S. Pat. No. 4,088,016). In contrast to optical methods, this measuring method allows to detect and to count also those filament ends which are incorporated in the yarn either permanently or temporarily, that is, which do not protrude due to a finish, size or spooling oil applied to the yarn.

The maximum yarn strength at 5 cm of clamping length of about 1.7 cN/dtex sets the upper limit for the range within which the intended hairiness, the textile properties comparable with those of staple fiber yarns and the required low pilling are obtained. This indicated maximum value depends to a small extent for example on the individual titer of the filaments; that is, at low individual titer of, for example, below 2 dtex, this maximum value may be exceeded by up to 10%.

As usual, the yarn tenacity is the quotient of the strength of the yarn and the starting titer. The tests were carried out using an Instron tenacity tester; the distance of the two clamping jaws from each other giving the clamping length. By Uster percentage or Uster value, there is to be understood as usual the variation coefficient of the mass of a yarn, as it can be determined by means of Zellweger-Uster evenness testers.

In addition to a defined strength at 5 cm of clamping length, the decrease of tenacity observed on extension of the clamping length from 5 to 200 cm is of special importance in order to ensure the intended textile properties of the filament yarn. It has been found that the yarn tenacity at a clamping length of 200 cm must not exceed 75% of the strength at a clamping length of 5 cm.

These relations are demonstrated by the diagram of FIG. 1 of the accompanying drawings, which shows the yarn strength depending on the clamping length of diverse filament yarns and a staple fiber yarn.

Curve a demonstrates the strength behavior of a conventional false twist texturized polyester yarn having no protruding filament ends.

Curve b shows the strength in relation to the clamping length of a bicomponent filament yarn having protruding filament ends which is obtained according to German Auslegeschrift No. 23 08 031.

Curve c demonstrates the behavior of a yarn obtained from a low-pilling raw material according to the art and texturized in the same manner as that of curve b. The precise data are indicated in Example 2 of this patent application.

Curve d characterizes the behavior of staple fiber yarn Nm 80/1 obtained by secondary spinning of modified low-pilling polyester fibers. The titer of the individual fibers was 1.7 dtex, and is length 38 mm.

Curve e shows the strength of a yarn according to the invention (see Example 1).

The residual strength of the tested yarns at 200 cm of clamping length, indicated in percent of the strength at 5 cm of clamping length, and the unevenness of the tested yarns measured by means of an Uster evenness tester are listed in the following Table.

| Yarn | Residual strength % | Uster % |
|---|---|---|
| a | 89 | 1.0 |
| b | 80 | 2.0 |
| c | 85 | 1.3 |
| d | 71 | 14.8 |
| e | 56 | 2.2 |

The yarn strength required in accordance with the invention is attained at a relatively low flex abrasion resistance of the protruding filament ends, preferably of from 50 to 400 cycles. This low flex abrasion resistance of the yarns of the invention is certainly the reason for the very good anti-pilling behavior of the textile webs manufactured therefrom despite the fact that the yarns of the invention are not twisted at all or provided with a low-grade protective twist only.

Yarns having the intended low flex abrasion resistance can be manufactured by spinning of fiber-forming polyester raw materials of low viscosity, preferably with the use of a polyvalent cross-linking or branching agent.

When trimethylolpropane is used as modification agent, it is suitably added in an amount of from 0.3 to 0.8 weight %, especially 0.5 to 0.7 weight %. Smaller amounts of, for example 0.2 weight % are sufficient still to reduce the flex abrasion resistance of the yarn manufactured from the corresponding raw material to such an extent that protruding filament ends according to German Auslegeschrift No. 23 08 031 are formed. However, the addition of such small amounts of trimethylolpropane is insufficient to decrase the flex abrasion resistance of the protruding filament ends in such a manner that satisfactorily low-pilling textile webs are obtained from such yarns. These yarns furthermore do not possess the properties of staple fiber yarns manufactured by secondary spinning. When the amount of modification agent added is increased above the cited range to, for example, 1 weight % of trimethylolpropane, filaments being extraordinarily brittle are the result, so that the yarn cannot be processed any more.

Similar limits have to be observed for the other known modification agents such as trishydroxymethylethane, glycerol, pentaerythritol, 3-hydroxy-2,2-bis-hydroxymethyl-propionic acid, trimellitic acid methyl ester, trimellitic acid anhydride and similar compounds. The required amounts can be calculated approximately in stoichiometric quantities on the above indications for trimethylolpropane. Optimum amounts can be found out by simple tests.

Surprisingly, it has been found that the yarns of the invention can be manufactured also as genuine monocomponent yarns, that is, yarns the filaments of which are identical with respect to titer, profile and orientation data. Such yarns can be manufactured in an especially simple manner requiring no special devices.

For several applications, on the other hand, yarns are suitable which consist of a uniform raw material the filaments of which, however, have a different cross section and/or titer, in order to obtain a special handle. These yarns are normally spun from a spinneret having different hole sizes.

The filament yarns of the invention having protruding filament ends which consist of the same filaments made from a modified polyester can be manufactured according to the process described as follows:

A filament raw material of a polyester modified by addition of trimethoxysilane-ethane-phosphonic acid diethyl ester, trimethylolpropane, pentaerythritol or trimellitic acid is spun in usual manner to filaments; the wind-up rates being preferably from 1400 to 3000 m/min. When chosing the usual spin finish to be applied to the spun filaments before wind-up, care has to be taken that the filaments provided with the finish have a crack index of more than 5. For, it has been found that filament yarns having a great number of protruding filament ends can be manufactured by false twist draw texturization from the same filaments in the case where a sufficiently high crack index is ensured by a suitable choice of the finish, and the feed yarn has a flex abrasion resistance of less than 1500 cycles before reaching the texturization zone as such, that is, the false twist spindle or the friction twister.

While according to the process of German Auslegeschrift No. 23 08 031 the number of broken filaments and the pilling behavior of the textile webs obtained from the yarn hitherto were inevitably predetermined by the extent of modification, variation of the finishes applied allows now an independent choice of the number of broken filament ends.

Although a precise correlation of the degree of hairiness to be expected and the use of finishes of known composition cannot be established as yet, there is provided a simple measuring method allowing to predict the degree of hairiness to be expected. It has been found that filaments which have a flex abrasion resistance of less than 1500 cycles and furthermore a crack index of more than 5, break at irregular intervals in the texturizing zone under the conditions of false twist texturization. When this crack index of 5 is not attained a crimped filament yarn having no protruding filament ends is obtained on false twist texturizing, while at a crack index of, for example, 100 a very hairy filament yarn is the result. Preferably, the crack index is in the range of from 10 to 100.

The correlation of the crack index with the hairiness of the voluminous filament yarn produced is however valid for those filaments only which have a reduced flex abrasion resistance of less than about 1500 cycles. Such filaments can be obtained by the above modification of the polyester raw material. Filaments having a normal flex abrasion resistance (about 3000 to 4000 cycles), however, do not produce hairy yarns on false twist draw texturizing, even at crack indices above 5.

The relation between flex abrasion resistance and tendency to pilling is described in detail in German Auslegeschrift No. 23 08 031. When in accordance with the invention undrawn, but preorientated filament yarns, especially from polyesters such as polyethylene terephthalate, are preferably used it is not necessary that the yarns have the required low flex abrasion resistance of less than 1500 cycles already before the combined drawing and texturizing operations. On the other hand, the required low flex abrasion resistance must be ensured in the moment where the feed yarn arrives at the twister of the false twist equipment. In this case, the flex abrasion resistance is determined on an optimally drawn feed yarn.

In this case, however, a higher flex abrasion resistance is generally attained than that resulting on draw texturization.

Figure 2:
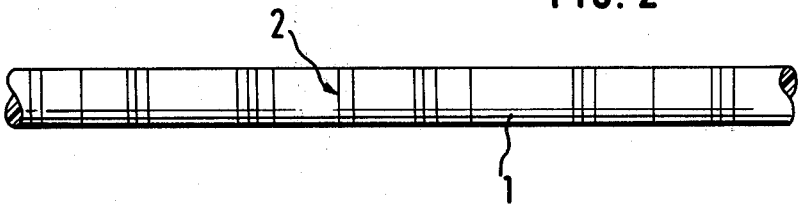

The crack index indicates the number of stress cracks which are observed per unit of filament length of a spinning yarn on cold drawing of undrawn or drawable filaments per mm of filament of a yarn. For test purposes, part of a drawable yarn is placed unter the microscope in such a manner that the individual filaments are well visible. One end of this yarn is fixed by clamping, the other free end is passed over a pulley and loaded with a weight in such a manner that the yarn is slowly drawn. During this drawing operation cracks possibly occurring over the circumference of the individual filaments can be well observed. The crack index is determined by letting proceed the drawing operation until a miximum of cracks has formed, stopping it at this moment and counting the number of cracks per unit of length of the filament in this state. The crack index indicates therefore the number of cracks per mm of filament of a yarn on which the maximum number of cracks has been observed. The test has to be repeated several times in order to determine a reliable average value. For demonstration purposes, FIG. 2 of the accompanying drawings shows a filament (1) where a number of stress cracks (2) can be observed.

When the drawing of the monofilaments is continued, the stress cracks disappear, the drawn yarn has no fissured zones any more, and it is practically identical in its appearance to a yarn treated with another spin finish which does not cause formation of stress cracks.

It has been found that there is a substantial correlation of the crack index with the number of protruding filament ends produced on false twist texturizing per unit of yarn length. It is therefore possible without any difficulty to obtain a defined crack index of drawable filaments by a suitable choice of the spin finish and thus to predetermine the intended hairiness of the voluminous filament yarns. The required flex abrasion resistance data of the filaments are not influenced by the kind of finish and therefore by the crack index measured, either; that is, the flex abrasion resistance and thus the pilling behavior of textile webs manufactured from these yarns can be adjusted independently from the intended hairiness. Voluminous, false twist texturized filament yarns having a great number of individual protruding filament ends can be manufactured from the same filaments only in this manner.

The draw texturization as such can be carried out with the use of normal false twist draw texturizing equipment. Suitable twisters are for example spindles having a sapphire shaft, preferably, however, the process is carried out by means of friction twisters.

The number of protruding filament ends as well as the crimp properties of the texturized yarn are influenced by the draw texturization conditions, that is, the simple correlation of crack index and hairiness exists only in the case of parameters remaining unchanged in any other respect.

The following Examples illustrate the invention. Some of the test data, for example tendency to pilling and flex abrasion resistance, are determined according to processes known from the literature, such as described for example in detail in German Auslegeschrift No. 23 08 031.

The hairiness of the voluminous filament yarns obtained was determined by means of a Shirley Yarn Hairiness Meter of Shirley Development Ltd., England. For example, this device allows to determine and to record optically filament ends protruding from the yarn for more than 2 mm.

EXAMPLE 1

A hairy yarn according to the invention was manufactured from a polyethylene terephthalate raw material which was modified with 0.5% of trimethylolpropane. The polymer had a relative viscosity of 1.57, measured at 25° C. on a solution of 1 g in 100 ml of a phenol/tetrachloroethane mixture (weight ratio 3:2). This material was forced at a temperature of 285° C. through spinnerets having 16 holes of a diameter of 0.30 mm and 32 holes of a diameter of 0.25 mm. The feed rate was 30 g/min, the wind-up rate of the filaments was 1500 m/min.

Before take-up a 12% aqueous emulsion of a preparation was applied to the filaments, which preparation was composed as follows:

| | |
|---|---|
| 47 parts by weight | trimethylolpropane-trilaurate |
| 26 parts by weight | polyoxyethylene sorbitol-hexaoleate |
| 20 parts by weight | ethylene oxide-propylene oxide copolymer molecular weight abt. 3000 |
| 20 parts by weight | n-nonylphenol · 10 EO (ethylene oxide) |
| 5 parts by weight | oleic acid |
| 2 parts by weight | potassium hydroxide |

The components of the preparation were commercial products of usual purity. The layer of preparation applied, measured as methanol extract, was 0.5%, relative to the total weight of the filaments. The crack index measured under the microscope was 27. The flex abrasion resistance was measured on individual filaments drawn by a 1:2.3 factor, and it was 420 cycles. The yarn so obtained was subjected as feed yarn to a texturizing machine provided with a heatable iron plate having a length of 1.5 m and a three-axle friction twister consisting of 12 disks having a ceramic surface, roughness degree 50, of Feldmühle AG.

The drawing ratio during the texturization was adjusted to the factor of 1:2.3. The heater had a temperature of 190° C. The stress before and after the twister was 20 cN, the wind-up rate amounted to 320 m/min.

The voluminous hairy yarn so obtained, which had a titer of dtex 87 f 32+16 was distinguished by a great number of protruding filament ends. Its hairiness was determined by means of the Shirley Hairiness Tester and amounted to 900/100 m (protruding filament ends having a length of from 1 mm on being included in the number). The strength behavior in relation to the clamping length is shown in FIG. 1 as curve e. The crimp $K_1$ was 13.5%, the stretch 15%. The flex abrasion resistance of the protruding filament ends was 250 for the filaments having an individual titer of 1.4 dtex, and 135 for those having an individual titer of 2.7 dtex.

EXAMPLE 2 (Comparison)

The spinning test described in the first part of Example 1 was repeated under exactly identical conditions, while however using a 15% aqueous emulsion of a preparation composed as follows:

| | |
|---|---|
| 95 parts by weight | pentaerythritol-ethoxylate-propoxilate (4:1) |
| 5 parts by weight | potassium dilaurylphosphate |

The layer of preparation applied, measured as methanol extract, was also 0.5%, the crack index, however, zero. A yarn so provided with a preparation was draw texturized under the conditions described in Example 1, thus obtaining a voluminous filament yarn having no broken filament ends whatsoever. The curve of strength in relation to the clamping length corresponds to curve c of FIG. 1.

EXAMPLE 3

A feed yarn in accordance with the invention having a titer of dtex 300 f 64 was manufactured by spinning of a polyethylene terephthalate modified with 0.5 weight % of trimethylolpropane and having a relative viscosity of 1.57. The filaments were finished in usual manner before wind-up with an aqueous emulsion of the preparation according to Example 1, the preparation layer applied was 0.75%, the wind-up rate of the filaments was 1500 m/min. A crack index of 14 was measured on the filaments.

Filaments drawn at a ratio of 1:2.2 had a flex abrasion resistance of about 450 cycles.

These yarns were subjected to draw texturization, where a three-axle friction twister consisting of 12 disks having a ceramic surface of a roughness degree of 50 (manufacturer: Feldmühle AG) produces the false twist. The feed yarns were drawn in this operation at a ratio of 1:2.54, the texturizing temperature was 195° C., and the final titer of the crimped hairy yarn was dtex 123 f 64.

The hairy yarns of the invention so obtained had a hairiness of 393/100 m yarn (hairs of more than 2 mm), a $K_1$ value of 14% and a flex abrasion resistance of 258. The curve of strength in relation to the clamping length of the yarn was practically not different from curve d in FIG. 1 standing for the fiber yarn obtained by secondary spinning.

The $K_1$ crimping data were determined according to the indications given on page 12 of German Offenlegungsschrift No. 22 11 843.

What is claimed is:

1. A voluminous, false twist texturized filament yarn having individual protruding filament ends which comprises the yarn being hairy and formed of filaments of a uniform polyester raw material, the improvement which comprises said polyester raw material contains as a fiber forming polymer a modified polyethylene terephthalate having a relative viscosity of from 1.5 to 1.65 and modified with a branching or cross-linking agent, said agent being in a stoichiometric ratio of the agent in the polyester raw material corresponding to the stoichiometric ratio of 0.3 to 0.8 weight % of trimethylolpropane in said raw material, the tenacity of the filament yarn at a clamping length of 5 cm being below 1.7 cN/dtex but above 1.3 cN/dtex, the tenacity at a clamping length of 200 cm being less than 75% of the strength at a clamping length of 5 cm, at least however 0.8 cN/dtex, and the unevenness of the yarn being less than 3 Uster %, the flex abrasion resistance of the filaments of said yarn being such that a web-like structure on processing of the yarn has low pilling.

2. The yarn as claimed in claim 1, wherein the protruding filament ends have a flex abrasion resistance of from about 50 to 400 cycles.

3. The yarn as claimed in claim 1, wherein the filaments have the same titer and profile.

4. The yarn as claimed in claim 1, wherein the filaments contain as fiber-forming polymer a modified polyethylene terephthalate having a relative viscosity of from 1.55 to 1.60.

5. The yarn as claimed in claim 1, wherein the fiber-forming polymer is polyethylene terephthalate modified by addition of from 0.5 to 0.7 weight %, of said cross-linking agent in a corresponding stoichiometric ratio.

* * * * *